US008100516B2

(12) United States Patent
Gehrin

(10) Patent No.: US 8,100,516 B2
(45) Date of Patent: Jan. 24, 2012

(54) THREE-COMPONENT PISTONLESS FLUID CAPACITOR

(75) Inventor: Robert E. Gehrin, Dardenne Prairie, MO (US)

(73) Assignee: Illinois Tool Works Inc., Glenview, IL (US)

( * ) Notice: Subject to any disclaimer, the term of this patent is extended or adjusted under 35 U.S.C. 154(b) by 529 days.

(21) Appl. No.: 12/326,298

(22) Filed: Dec. 2, 2008

(65) Prior Publication Data

US 2009/0147059 A1 Jun. 11, 2009

Related U.S. Application Data

(60) Provisional application No. 60/992,596, filed on Dec. 5, 2007.

(51) Int. Cl.
*B41J 2/175* (2006.01)

(52) U.S. Cl. ..... 347/85

(58) Field of Classification Search ..... 347/84, 347/85

See application file for complete search history.

(56) References Cited

U.S. PATENT DOCUMENTS 6,971,739 B2 * 12/2005 Sadasivan et al. ..... 347/85
2011/0079140 A1 * 4/2011 Baseley ..... 92/90

* cited by examiner

*Primary Examiner* — Huan Tran
(74) *Attorney, Agent, or Firm* — Levenfeld Pearlstein, LLC

(57) ABSTRACT

A device and method for storing pressure-regulated fluid for a printer is disclosed. The pistonless, pressure-regulated storage device for fluid has three main components: a sealing cap, a mounting base, and a flexible membrane positioned between the sealing cap and the mounting base. The sealing cap has an inlet and an outlet for fluid flow. A pressure sensing device is positioned to monitor the pressure in the fluid storage device. The mounting base has a chamber formed therein and the membrane is positioned over the chamber. The membrane is flexible and configured to conform to the shape of the chamber when the membrane retains fluid, such as ink, from a reservoir. The membrane accumulates fluid until a pressure sensor alerts the pump that the maximum capacity has been reached. When pressure within the storage device falls, such as when downstream demand for ink begins or increases, the pump is signaled to begin filling the storage device.

20 Claims, 4 Drawing Sheets

THREE-COMPONENT PISTONLESS FLUID CAPACITOR

BACKGROUND OF THE INVENTION

The present invention is directed to a device used to store pressure-regulated fluid. More particularly, the present invention pertains to a fluid capacitor for storing pressurized fluid for a printing device.

Printers are used in many applications including industrial applications. In these applications, it is important that the print heads operate reliably. Reliability can be reduced when there are pressure disturbances in the system. Thus, maintaining a constant fluidic pressure to the print head without reduction in reliability is essential. Particularly helpful in this pursuit are devices which store volume under pressure.

The classic method of storing volume under pressure utilizes an accumulator. The accumulator typically functions by deflecting a rolling diaphragm using spring pressure and a piston, as well as various retaining and sealing components. The accumulator charges with ink, and pressure is created by deflecting the spring, the rolling diaphragm, the piston, and the sealing disk. However, mechanical abrasion is created between the components. For example, abrasion can occur between the piston's peripheral wall and the cylinder's internal wall, and between the spring's surface and the piston's internal wall. To combat the abrasion, the components' surfaces must be specially treated and lubricated and regular maintenance is required.

Another method of accumulating pressurized fluid includes pressurizing the ink supply tank. Unfortunately, there are inherent drawbacks and considerable expense involved. Even though an inexpensive air pump can be purchased to pressurize a tank, a more elaborate device is required to prevent the tank from malfunctioning. If all relevant mechanisms are not engaged and if preventative maintenance is not performed, eminent failures can occur.

Accordingly, a device which can regulate fluid flow in a printer and causes little or no wear on components is needed. Desirably, such a device is inexpensive, easy to manufacture and assemble, and requires relatively little maintenance.

BRIEF SUMMARY OF THE INVENTION

A pistonless fluid storage device capable of providing pressure-regulated ink to a printer is disclosed. The pistonless storage device for fluid has three main components: a sealing cap, a mounting base operably connected to the sealing cap, and a flexible membrane positioned between the sealing cap and the mounting base. The sealing cap has an inlet and an outlet for fluid flow. A pressure sensing device is positioned around, in, or downstream of the pistonless fluid storage device to monitor the pressure in the fluid storage device.

The mounting base has a chamber formed therein and the membrane is positioned over the chamber. The membrane is flexible and configured to conform to the shape of the chamber when the membrane retains fluid, such as ink. The membrane continues to accumulate fluid until the pressure sensor alerts a pump that the maximum fluid capacity has been reached for the membrane and/or storage device. The pump then stops the flow of ink to the storage device. As downstream demand for ink begins or increases, the ink flows from the ink supply held by the membrane, through the outlet in the sealing cap, to the print head downstream. The pressure in the storage device decreases and the pressure sensing device alerts the pump to begin filling the storage device again. This cycle can continue indefinitely.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
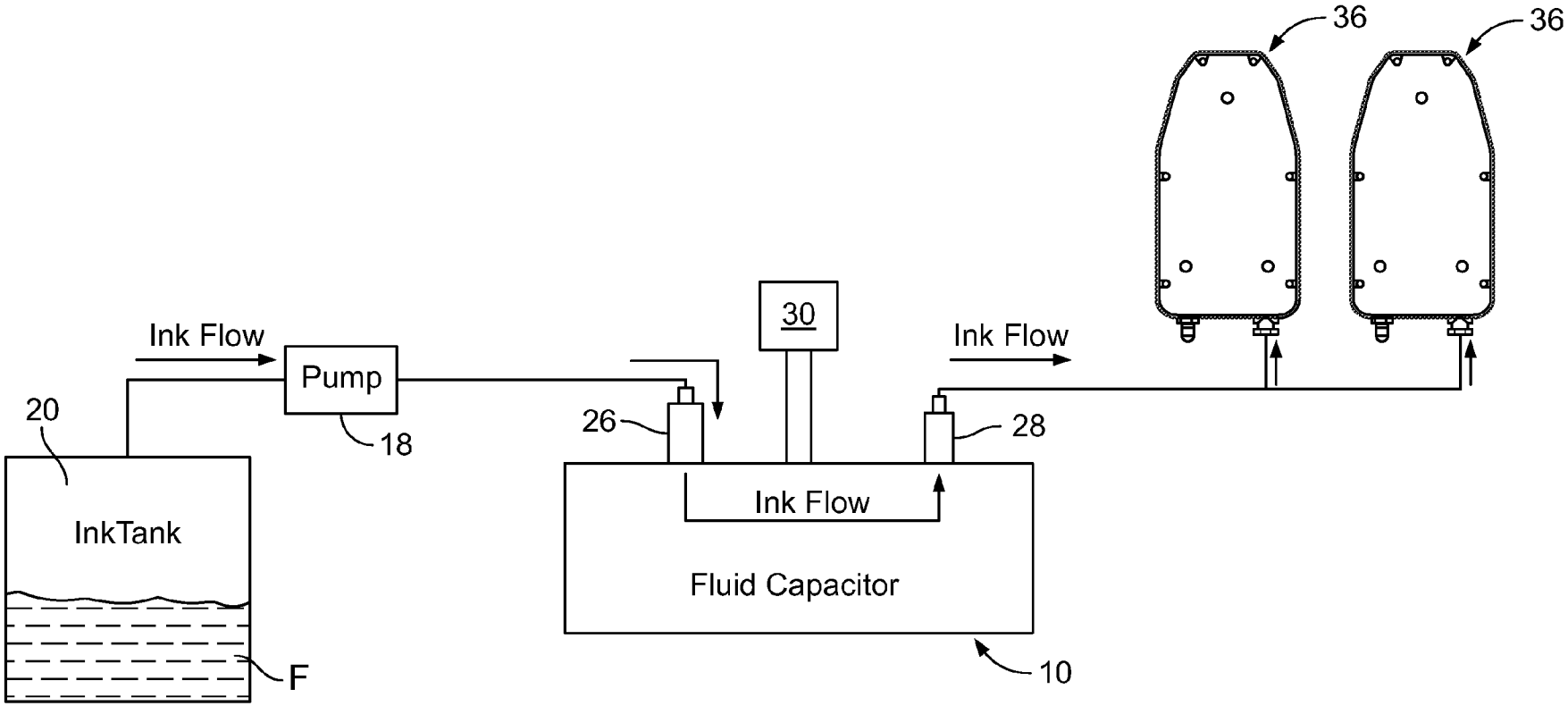
FIG. 1 is a schematic illustration of a fluid delivery system having a pistonless fluid storage device embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Figure 2:
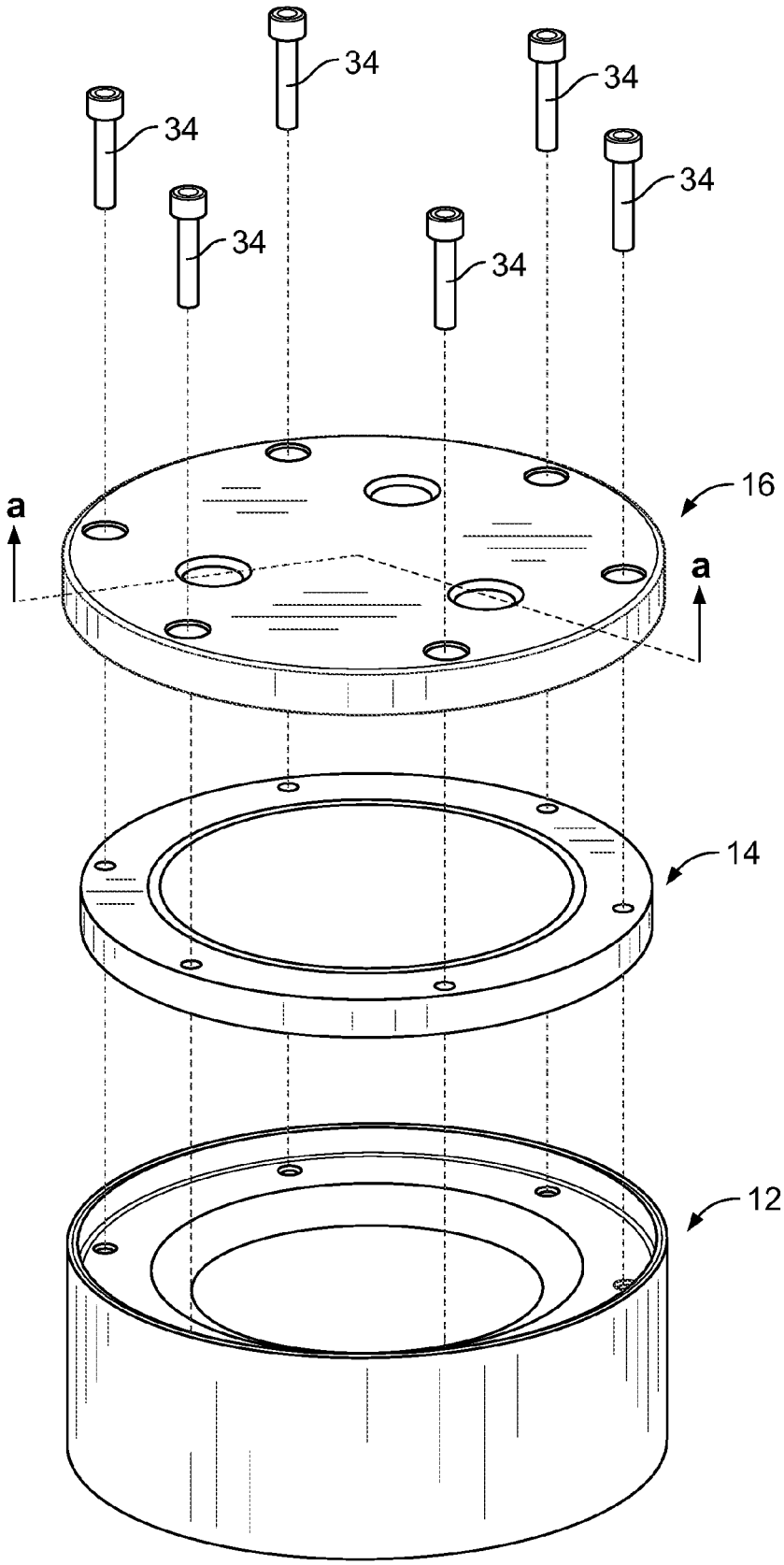
FIG. 2 is an exploded view of the pistonless fluid storage device showing the three main components of the pistonless fluid storage device: the base, the membrane, and the cap.

Referring now to the figures, an embodiment of a pistonless fluid ink capacitor 10 used in a typical inkjet printing application is shown. Generally, the printing system has an ink reservoir 20 and one or more print heads 36. The fluid capacitor 10 has the ability to store a volume of fluid F under pressure. The present fluid ink capacitor 10 stores fluid F by means of three components, as shown in FIG. 2. These components include a mounting base 12, an elastic membrane 14, and a sealing cap 16. The three components, the base 12, the membrane 14, and the cap 16 are all coupled together in the present embodiment by fasteners 34, although other mechanisms which couple all three components together, such as glues, tapes, staples, welding and the like are also contemplated.

The sealing cap 16 is formed from a rigid material that is inert to ink, such as plastics and/or stainless steel. The sealing cap 16 has an inlet 26 and an outlet 28 formed therein. An optional third port 30 is also present.

The elastic membrane 14 is formed from a flexible, non-porous material, such as natural, latex, silicon rubber, plastics or other type of flexible, non-porous polymer. The membrane 14 is pliable and configured to stretch and relax repeatedly without tearing, stiffening or over-absorption of fluid.

The mounting base 12 may be formed from any suitably rigid natural or synthetic material, such as stainless steel, aluminum, or molded plastic. It is unnecessary for the mounting base 12 to be formed from an inert material because the base 12 is isolated from the fluid F by membrane 14.

Referring now to FIG. 1, a schematic illustration of a printing system is shown wherein a pump 18 is used to draw fluid F out of the supply tank or reservoir 20. While the present embodiment uses ink as a fluid F, the type of fluid is not limited to ink, but to any type of fluid under pressure. The same pump 18 drives the fluid F into the fluid capacitor 10. Increasing fluid F volume increases the pressure in the fluid capacitor 10 when the downstream usage by the print head of the fluid F is less than the feed from the pump 18 to the fluid capacitor storage device 10.

Figure 3:
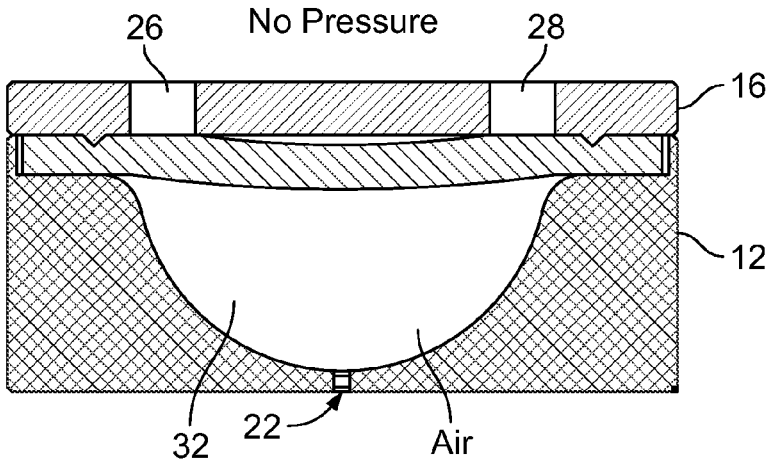
FIG. 3 is a cross-sectional view of the pistonless fluid storage device, taken along line a-a of FIG. 2, when the storage device does not contain fluid.
Figure 4:
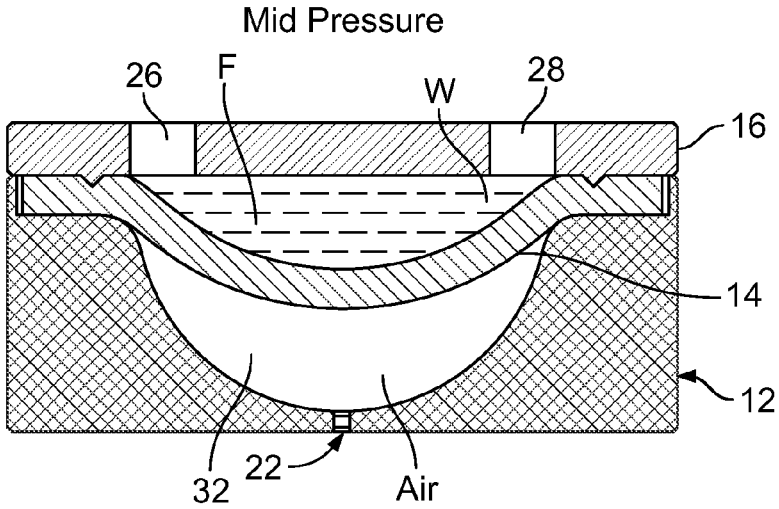
FIG. 4 is a cross-sectional view of the pistonless fluid storage device, taken along line a-a, when the storage device is partially filled with fluid and the membrane begins to deflect.
Figure 5:
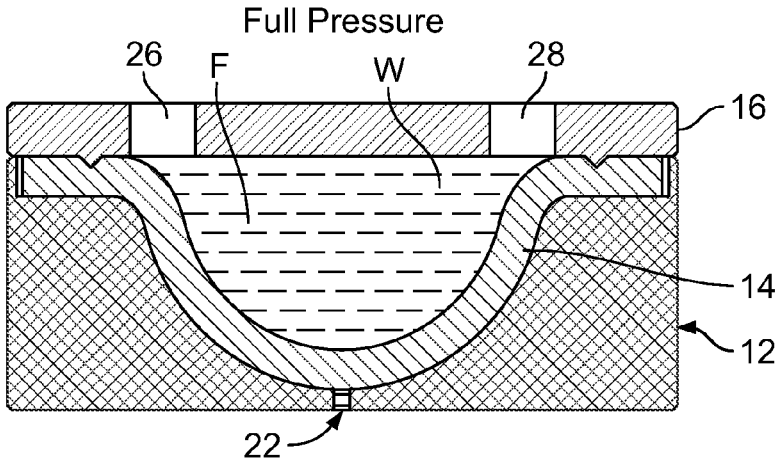
FIG. 5 is a cross-sectional view of the pistonless fluid storage device, taken along line a-a, when the storage device is filled with fluid and the membrane is fully deflected and conforms to the shape of the chamber of the base.

As shown in FIGS. 3-5, the flexible membrane 14 has little to no deflection when there is no supply pressure from the pump 18. During filling, however, the flexible membrane 14 deflects or caves under fluid F pressure, and in the present embodiment, cups the fluid in a well W. The membrane 14 forms a well W into which fluid F accumulates and also forms a liquid barrier such that the fluid F does not enter into the base chamber 32. A pressure monitor (not shown) may be inserted through a port 24 of the sealing cap 16 into the ink/fluid F in the well W to monitor the pressure of the fluid F.

As fluid F pressure increases, the flexible membrane 14 conforms to the predetermined geometrically-shaped chamber 32. The chamber can be one of any conic sections (e.g. spherical, parabolic, hyperbolic, cone, etc.), or as simple as a cylinder. The spherically-shaped chamber 32 shown in FIGS. 3-5, however, is straight-forward for manufacturing. The size and shape of the chamber 32 in the base 12 are factors which determine the maximum fluid pressure and volume in the pistonless storage device 10. The predetermined size and shape prevent over-pressurization of the fluid F and are easily scalable for use in different types of printers or other applications.

The flexible membrane 14 increasingly forms a concave-type well W as the amount of fluid F volume, and thus pressure, builds. As pressure builds in the well W, the vent 22 in the mounting base 12 allows the air that would otherwise be compressed by the concaving membrane 14, to vent to the atmosphere. Venting of the air allows the fluid capacitor 10 to continue building fluid F pressure and volume.

Figure 6:
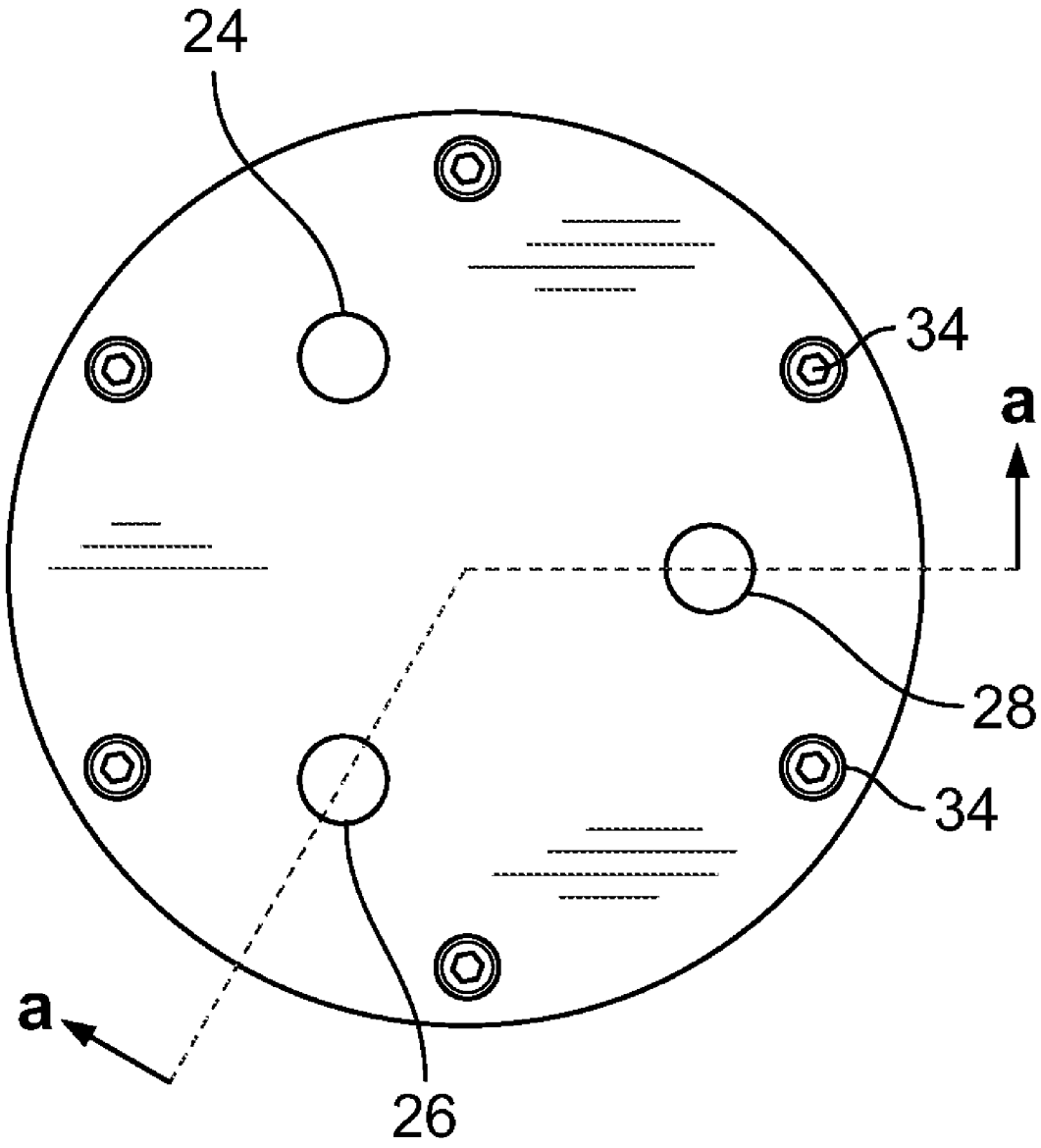
FIG. 6 is a plan view of the sealing cap of the pistonless fluid storage device.

At or near the desired full pressure, the flexible membrane 14 conforms to the geometric base 12 of the fluid capacitor 10. The pressure measuring device can be mounted into the port 24 (FIG. 6) or coupled downstream to the printing apparatus as a means of monitoring and/or controlling fluid capacitor 10 pressure.

As downstream demand (e.g. printing) consumes the fluid F, fluid F in the well W flows out of the well W, through the fluid outlet 28, to the print heads 36. As the fluid F leaves the well W, the fluid volume and pressure decreases, the flexible membrane 14 relaxes, and air is allowed to refill the chamber 32 through vent 22.

When the fluid F pressure reaches a desired minimum, the pressure measuring/monitoring device, located in, around, or downstream of the fluid capacitor 10, signals re-activation of pumping. The pump 18 continues until the pressure measuring/monitoring device signals the desired maximum pressure. At that point, the pump 18 stops delivering fluid F to the storage device 10. This cycle continues. Notable is the fact that without the fluid capacitor 10, the pump 18 would operate continuously. With the fluid capacitor 10, however, the pump 18 operates in a pulse width modulation type mode, preventing the pump 18 from continuous operation.

By storing fluid F volume and pressure, the fluid capacitor 10 assists in maintaining print continuity by accommodating changes in downstream demand. Fluid pressure, as seen at the print head, does not fluctuate, allowing for increased quality and reliability in printing. In addition, all three primary components, the base 12, the membrane 14, and the cap 16 are easily manufactured. Although the membrane 14 stretches and relaxes, there are no moving hard components which would be subject to abrasion and no special material treatments or lubrications are necessary.

The membrane 14 is easily scalable to accommodate different pressures and volumes to meet any industrial and/or residential pressurized fluid application. This includes, but is not limited to, printer applications. Additionally, a change in the cap 16 and/or membrane 14 materials would accommodate many, if not most, fluid types. Moreover, the fluid capacitor 10 increases pump 18 life by reducing internal heat. As can be seen, the fluid capacitor herein disclosed provides numerous benefits, advantages, and improvements for pressurized fluid regulation.

All patents referred to herein, are incorporated by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A pistonless fluid storage device for a printer, the printer having a reservoir and at least one print head, the reservoir having a fluid, wherein a pump propagates movement of the fluid through the printer and the pistonless fluid storage device, the pistonless fluid storage device for fluid comprising:

a sealing cap, the sealing cap having an inlet and an outlet configured for fluid flow;

a mounting base operably connected to the sealing cap, the mounting base having a chamber formed therein and separate from the fluid; and a flexible membrane positioned between the sealing cap and the mounting base, the membrane configured to conform to the shape of the chamber when the membrane retains fluid and provides a barrier between the sealing cap and the mounting base.

2. The pistonless fluid storage device for a printer of claim 1 wherein the fluid flows from the reservoir to the pistonless fluid storage device.

3. The pistonless fluid storage device for a printer of claim 1 wherein the fluid accumulates in the pistonless fluid storage device in a well formed by the flexible membrane.

4. The pistonless fluid storage device for a printer of claim 3 wherein a fluid pressure within the well increases as a fluid volume increases within the well.

5. The pistonless fluid storage device of claim 4 wherein a pressure gauging device monitors the pressure of the fluid within the well.

6. The pistonless fluid storage device of claim 5 wherein the pressure gauging device signals when the fluid pressure is at a minimum.

7. The pistonless fluid storage device of claim 6 wherein fluid enters the pistonless fluid storage device.

8. The pistonless fluid storage device of claim 7 wherein the pressure gauging device signals when the fluid pressure is at a maximum.

9. The pistonless fluid storage device of claim 8 wherein the flow of fluid to the pistonless fluid storage device is stopped.

10. The pistonless fluid storage device of claim 9 wherein the fluid exits the well, the pressure of the fluid decreases and the pistonless fluid storage device cycles.

11. The pistonless fluid storage device of claim 3 wherein as fluid increases in the well, the flexible membrane cups into the chamber.

12. The pistonless fluid storage device for a printer of claim 1 wherein the chamber has a vent.

13. The pistonless fluid storage device for a printer of claim 12 wherein the vent allows air from the chamber to escape.

14. The pistonless fluid storage device for a printer of claim 13 wherein the fluid is pumped from the pistonless fluid storage device to the at least one print head.

15. A method for providing a pressure-regulated fluid supply to a print head, the method comprising the steps of:

providing a fluid storage device having a sealing cap, a flexible membrane and a mounting base, wherein the flexible membrane prevents the fluid from communicating with the mounting base;

positioning the fluid storage device between a fluid reservoir and the print head;

storing an amount of fluid from the reservoir in the fluid storage device, the flexible membrane in the fluid storage device forming a well to accumulate the fluid in the fluid storage device; and driving the pressure-regulated fluid from the fluid storage device to the print head on demand.

16. The method for providing a pressure-regulated fluid supply to a print head of claim 15, the mounting base having a chamber into which the flexible membrane conforms when accumulating fluid.

17. The method for providing a pressure-regulated fluid supply to a print head of claim 16 further comprising the step of:

venting air from the chamber of the mounting base to the atmosphere.

18. The method for providing a pressure-regulated fluid supply to a print head of claim 15, further comprising the step of:

signaling when a maximum or a minimum amount of pressure is present in the fluid storage device.

19. The method for providing a pressure-regulated fluid supply to a print head of claim 15, further comprising the step of:

signaling when a maximum amount of pressure is present in the fluid storage device and stopping flow to the fluid storage device.

20. The method for providing a pressure-regulated fluid supply to a print head of claim 15, further comprising the step of:

signaling when a minimum amount of pressure is present in the fluid storage device and beginning flow to the fluid storage device.

* * * * *